US010524310B2

(12) United States Patent
Bohlender et al.

(10) Patent No.: US 10,524,310 B2
(45) **Date of Patent: *Dec. 31, 2019**

(54) PTC HEATING ELEMENT AND ELECTRIC HEATING DEVICE FOR AN AUTOMOTIVE VEHICLE COMPRISING SUCH A PTC HEATING ELEMENT

(71) Applicant: Eberspacher catem GmbH & Co. KG, Herxheim (DE)

(72) Inventors: Franz Bohlender, Kandel (DE); Patrick Kachelhoffer, Seebach (FR); Andreas Schwarzer, Frankfurt am Main (DE); Kurt Walz, Hagenbach (DE)

(73) Assignee: Eberspächer catem GmbH & Co. KG, Herxheim (DE)

( * ) Notice: Subject to any disclaimer, the term of this patent is extended or adjusted under 35 U.S.C. 154(b) by 564 days.

This patent is subject to a terminal disclaimer.

(21) Appl. No.: 15/169,847

(22) Filed: Jun. 1, 2016

(65) Prior Publication Data

US 2016/0360572 A1 Dec. 8, 2016

(30) Foreign Application Priority Data

| | | |
|---|---|---|
| Jun. 2, 2015 | (EP) | 15170330 |
| Jun. 2, 2015 | (EP) | 15170336 |
| Nov. 9, 2015 | (EP) | 15193710 |

(51) Int. Cl.

| | |
|---|---|
| ***H05B 1/02*** | (2006.01) |
| ***H05B 3/06*** | (2006.01) |
| ***H05B 3/18*** | (2006.01) |

(52) U.S. Cl.
CPC ..... *H05B 1/0236* (2013.01); *H05B 3/06* (2013.01); *H05B 3/18* (2013.01)

(58) Field of Classification Search
CPC ..... H05B 1/0236; H05B 3/06; H05B 3/18; H05B 3/50; H05B 2203/013;
(Continued)

(56) References Cited

U.S. PATENT DOCUMENTS 4,104,509 A * 8/1978 Van Bokestal ..... H01C 1/02 219/544
4,835,370 A * 5/1989 Van Bokestal ..... H05B 3/14 219/504

(Continued)

FOREIGN PATENT DOCUMENTS

CN 102970781 A 3/2013
CN 204180283 U 2/2015

(Continued)

*Primary Examiner* — Shawntina T Fuqua
(74) *Attorney, Agent, or Firm* — Boyle Fredrickson, S.C.

(57) ABSTRACT

A PTC heating element is provided that includes including a PTC heating element strip conductors via which the PTC element is powered and at least one of which is insulated on an outer surface with an electrical insulation layer. In order to provide improved insulation while maintaining adequate heat transfer from the PTC element to the heat-emitting surface through the electrical insulation layer, the electrical insulation layer comprises a film and an electrically insulating mass of good thermal conductivity applied to the film. Also provided is an electric heating device for an automotive vehicle that is provided with at least one PTC heating element of such a type.

17 Claims, 4 Drawing Sheets

(58) Field of Classification Search
CPC ..... H05B 2203/017; H05B 2203/02; H05B 2203/023; H05B 3/24; H05B 3/02; H05B 3/30; F24H 3/0429; F24H 9/1872; F24H 2250/04; F24H 3/0435; F24H 3/0447
See application file for complete search history.

(56) References Cited

U.S. PATENT DOCUMENTS

| | | | | |
|---|---|---|---|---|
| 4,998,008 | A | 3/1991 | Menhardt | |
| 2007/0068913 | A1 | 3/2007 | Zeyen et al. | |
| 2008/0000889 | A1 | 1/2008 | Niederer et al. | |
| 2009/0255914 | A1* | 10/2009 | Bohlender ..... | F24H 3/0405 219/202 |
| 2012/0061366 | A1* | 3/2012 | Kohl ..... | F24H 3/0429 219/202 |
| 2012/0085742 | A1 | 4/2012 | Niederer et al. | |
| 2013/0191985 | A1 | 8/2013 | Qin et al. | |
| 2015/0215994 | A1 | 7/2015 | Bohlender et al. | |

FOREIGN PATENT DOCUMENTS

| | | | |
|---|---|---|---|
| DE | 28 45 894 | A1 | 4/1980 |
| DE | 29 48 593 | A1 | 6/1981 |
| DE | 82 30 799 | U1 | 3/1983 |
| DE | 691 11 237 | T2 | 2/1996 |
| EP | 0 057 172 | A2 | 8/1982 |
| EP | 2 190 256 | A1 | 5/2010 |
| EP | 2 211 589 | A1 | 7/2010 |
| EP | 2 211 590 | A1 | 7/2010 |
| EP | 2 397 788 | A1 | 12/2011 |
| EP | 2 637 475 | A1 | 9/2013 |
| EP | 2 395 296 | B1 | 4/2016 |

* cited by examiner

PTC HEATING ELEMENT AND ELECTRIC HEATING DEVICE FOR AN AUTOMOTIVE VEHICLE COMPRISING SUCH A PTC HEATING ELEMENT

BACKGROUND OF THE INVENTION

1. Field of the Invention

The present invention refers to an electric heating device for an automotive vehicle and a PTC heating element as such which is installed in said electric heating device.

2. Description of the Related Art

PTC elements have been widely accepted in electric heating devices for automotive vehicles, which is due to the self-regulating properties of PTC elements. Normally, a heat-generating element in an electric heating device consists of at least one PTC element and of strip conductors which are mounted at both sides in an electrically conducting, manner on the PTC element, and normally serve the electrical connection of the PTC element. Such heat-generating elements lie either directly or with interposition of an insulating layer against heat-emitting surfaces. The PTC elements are normally installed such that the PTC element delivers heat at both sides to heat-emitting surfaces.

Examples of electric heating devices with an insulation layer which covers at least one of the strip conductors on the outside are for instance given in EP 1 768 459 A1 and EP 2 637 475 A1, respectively.

EP 1 768 459 A1 discloses an electric heating device for heating air, in which the heat-emitting surfaces are formed by corrugated rib layers which adjoin the PTC element at both sides. In the already known prior art, plural PTC elements are accommodated in a positioning frame and contacted at both sides with contact sheets which form the generic strip conductors and serve the electrical connection of the PTC element.

An electric heating device which is also of the generic type is for instance known from EP 1 872 986 A1. In this prior art, heating ribs project into a circulation housing through which a fluid flows that is to be heated. The heating ribs form a U-shaped pocket which accommodates the PTC element as well as the strip conductors and insulation layers, which are respectively provided on the outside on the strip conductors. The PTC element and the strip conductors which are adjacent thereto at both sides for powering purposes are thereby accommodated in an electrically insulating manner in the heating rib. However, it is sometimes possible, for instance during operation of the electric heating device with the system voltage of an automotive vehicle of 12 V, to provide an insulation just at one side and to contact the PTC element directly with mass at the other side. "Mass" can here be formed by the outside of a heating rib or by a corrugated rib layer which at one side lies in a heat-conducting manner against the PTC element(s).

In the prior art known from EP 1 768 458 A, the insulation layer is formed by a two-layered structure which comprises a polyimide film and a ceramic layer. Especially in high-voltage applications and specifically in consideration of the operation of the electric heating device in an electric vehicle, attention must be paid to a safe electrical insulation of the PTC element and of the strip conductors contacting the element at both sides. A laminated insulation film for the same purposes is described in EP 2 109 345 A1.

SUMMARY OF THE INVENTION

The present invention wants to make a contribution to this. The present invention is based on the problem to indicate a PTC heating element which is electrically insulated on the outside in an improved manner, wherein the necessity of an adequate heat transfer from the PTC element to the heat-emitting surface through the electrical insulation layer is also to be taken into account.

To solve the above problem, the present invention indicates a PTC heating element comprising at least one PTC element, electrical strip conductors each having an inner surface in electrical contact with the PTC element, and an electrical insulation layer provided on an outer surface of at least one of the electrical strip conductors. The electrical insulation layer includes a film and an electrically insulating mass of good thermal conductivity applied thereto. As a rule, the film together with the mass is first prepared as a unit and then placed as a prefabricated hybrid film, including the film and the electrically insulating mass applied thereto, on the outside against at least one of the electric strip conductors.

The electrical insulation layer has here a layer structure with a normally continuous film and an electrically insulating mass of good thermal conductivity normally applied thereto at a constant thickness. Especially on account of the elastic and electrically insulating mass, the film according to the invention offers the possibility of compensating irregularities, which may also be small particles such as dust grains, between the strip conductor and a heat-emitting counter-surface of an electric heating device particularly in an automotive vehicle, whereas in standard insulation films as the insulation layer, which may also attract impurities due to electrostatic action, the insulation on the outside of the PTC element may be penetrated and thus bridged by such irregularities, with the consequence that the voltage applied to the PTC element is in fact not isolated with respect to the heat-emitting surface. This may cause short-circuiting within the electric heating device and thus failure. Without a corresponding switch-off device, a life-threatening condition may be created.

The electrically insulating mass is preferably a paste-like mass which is preferably, however, already cross-linked and thus set, so that it is no longer flowable in the strict sense. The mass, however, can perform certain compensating movements to evade e.g. at positions within the insulating layer with a localized pressure application, to absorb the localized pressure in this process and to equalize it, without the insulating effect created by the electrical insulation layer being lost thereby. A mass of good thermal conductivity preferably shows a thermal conductivity of at least 3 W(m*K), particularly preferably of a least 5 W/(m*K). The electrically insulating mass can be applied to the film with a technique which is used in the manufacture of adhesive tapes and in which the film is passed via rollers through a bath consisting of the electrically insulating mass. To this end the electrically insulating mass is blended with a solvent, whereby the viscosity of the electrically insulating mass is reduced or the wetting of the film can be improved. A plastic mass which after the coating of the film sets or cures completely or in part is normally used as the electrically insulating mass. Preferably, a crosslinking plastic is used, and after the coating of the film said plastic can cure in an accelerated manner also by addition of heat and/or exposure to radiation. To this end the device provided for producing the insulating layer normally has a heating or irradiation section through which the mass-coated film passes.

An electrical insulation layer which is first prepared in this way can then be laid against the outside of the at least one, preferably both strip conductors of the PTC element. This strip conductor may be formed by a metal sheet or in a printed layer.

Apart from the above-mentioned coating of the film in a system of rollers and in a melting bath of the electrically insulating mass, said mass can also be applied by printing or spraying onto the film, with a doctor blade being here preferred in case of printing.

The mass normally comprises a silicone mass preferably as a liquid phase. Preferably, the liquid phase is formed by an addition-curing 2-component silicone which cures at room temperature and cures in a forced manner under heat. The mass has a viscosity between 100 and 200 Pa a at 25° C. With a view to good flowability, gasoline or toluene is normally added as a diluter to the 2-component silicone to obtain a viscosity in a range between 4 and 15, preferably between 5 and 8 Pa s, at 25° C. In the cross-linked state the component of the mass that forms the liquid phase should have a Shore A hardness of about 10-40. This liquid phase has normally added thereto a solid which enhances thermal conductivity, but is nevertheless electrically insulating.

The mass is preferably chosen such that there are good wetting properties with respect to the particles with good thermal conductivity. The particles can additionally be treated with an adhesive before the particles are put into the paste-like mass to disperse the particles uniformly therein. The mass may e.g. be a silicone mass or at least predominantly comprise a silicon mass.

With a view to the electrical insulation properties of the insulating layer, this filler amount is normally formed by electrically insulating particles of good thermal conductivity, with particles of aluminum oxide being preferred, specifically gas- or water-diluted particles that can be packed on account of their morphology relatively tightly within the liquid phase and do not deteriorate the flow properties of the filled insulating mass to such an extent as do particles of a different morphology. The filler amount of the particles of good thermal conductivity within the liquid phase is at least 50 vol. %, particularly preferably between 85 vol. % and 95 vol. %. Such a volume proportion of filler within the mass improves the thermal conductivity on account of the good thermal conductivity of the particles, but does not impede the flowing of the paste-like mass and thus the application of the mass in a molten state to the film.

According to a preferred development the insulation layer consists of the film and the electrically insulating mass, wherein the electrically insulating mass itself may have several phases, namely for instance the filler amount and the liquid phase. The development has the consequence that the shape of the insulation layer is solely given by the film and the electrically insulating mass, wherein the film at the side facing away from the mass may additionally be made self-adhesive and may thus be provided with an adhesive layer. Said adhesive layer is normally provided on the prefabricated insulation layer. It is applied to the film at one side after or before the electrically insulating mass has been applied to the opposite surface of the film.

Due to the self-regulating properties of PTC elements the layer thickness should be restricted. For instance, according to a preferred development of the present invention it is suggested that the electrically insulating layer should be provided with a thickness of not more than 250 μm.

The insulating layer has a layer thickness between 100 and 300 μm, preferably between 150 μm and 250 μm. These thickness dimensions ensure an adequate electrical safety, i.e. reliable insulation of the PTC element on the outside by the electrical insulation layer with an adequate absolute heat delivery through the electrical insulation layer which with a view to the self-regulating properties of the PTO element is advantageous for an efficient operation of said element. Practical tests have shown that particularly with a mass filled with electrically insulating filler particles, particularly applied to a polyimide layer on the one hand at a layer thickness of 250 μm of the insulating layer, one can achieve on the whole a specific dielectric strength of 20 kV/mm, a volume resistivity of $1.9*10^{15}$ ohm/cm, and a creep resistance of CTI>600. The electrical insulation layer is here temperature-resistant i.e. stable preferably within a temperature range of −40° C. to 260° C.

Hence, the present invention indicates an electrical insulation layer which has a good thermal conductivity, so that the PTC element can be operated with high efficiency, which layer can further be prepared and produced without difficulty as a material sold by the meter and can thus be processed easily and further shows a high temperature stability. Since the film serves as a carrier for the insulating mass within the electrical insulation layer and since the electrical insulation and the good thermal conductivity are above all achieved through the insulating mass, the mass may also be provided on both sides of a film for which a smaller thickness has been chosen. In such a case attention must just be paid to a good heat stability of the film within the electrically insulating layer. Furthermore, mechanical properties such as high tear strength, or the like, are desired. The thinner the thickness chosen for the film within the electrical insulation layer, the less attention must be paid to a good thermal conductivity of the film itself.

The liquid phase of the electrically insulating mass, i.e. the liquid phase of the suspension, which possibly absorbs particles of good thermal conductivity, is formed from a cold-curing 2-component mass. Preferably, the liquid phase consists solely of such a 2-component mass. Such a cold-curing mass cures normally upon heating of not more than 80° C. within a few minutes, i.e. within 2 to 8 minutes. Higher temperatures are not required for achieving a curing of the mass.

In a preferred development, the strip conductor normally consists of a punched contact sheet which also forms the connecting lugs for the electrical connection of the heat-generating layer. The heat-generating layer is here the PTC element with the strip conductors lying against it or being directly connected thereto and the insulation layer provided on the outside. The at least one PTC element and the contact sheets which are normally directly adjacent thereto can be provided as a pre-mounted unit in a frame which holds together these elements of the heat-generating element to form a pre-mounted unit, as is e.g. described in EP 1 921 896 and EP 2 637 475, respectively. The paste-like mass is applied to this pre-mounted unit, so that the outer surface of the contact sheet is provided with the insulation layer. If a wedge element is used for clamping the heat-generating element in a U-shaped pocket and is possibly movably guided and held on the frame, as is known from EP 1 921 896 A1, a slide layer is normally positioned at this side between the electrical insulation layer, and the wedge element can slide past said slide layer in an improved manner when the heat-generating element is clamped in the pocket. Such a layer can for instance be formed by a sheet metal strip which is provided between the wedge element and the mass.

The present invention also suggests a heating device, particularly for an automotive vehicle, with heat-emitting surfaces. These heat-emitting surfaces may be outer surfaces of a radiator element provided with corrugated ribs or, however, opposing inner surfaces of a substantially U-shaped pocket of a liquid heater.

The electric heating device suggested with its independent aspect is particularly a heating device for high-voltage applications in an automotive vehicle. The heating device is here operated at a voltage of up to 800 V.

BRIEF DESCRIPTION OF THE DRAWINGS

Further details and advantages of the present invention become apparent from the following description of embodiments in combination with the drawing, in which.

DETAILED DESCRIPTION

Figure 1:
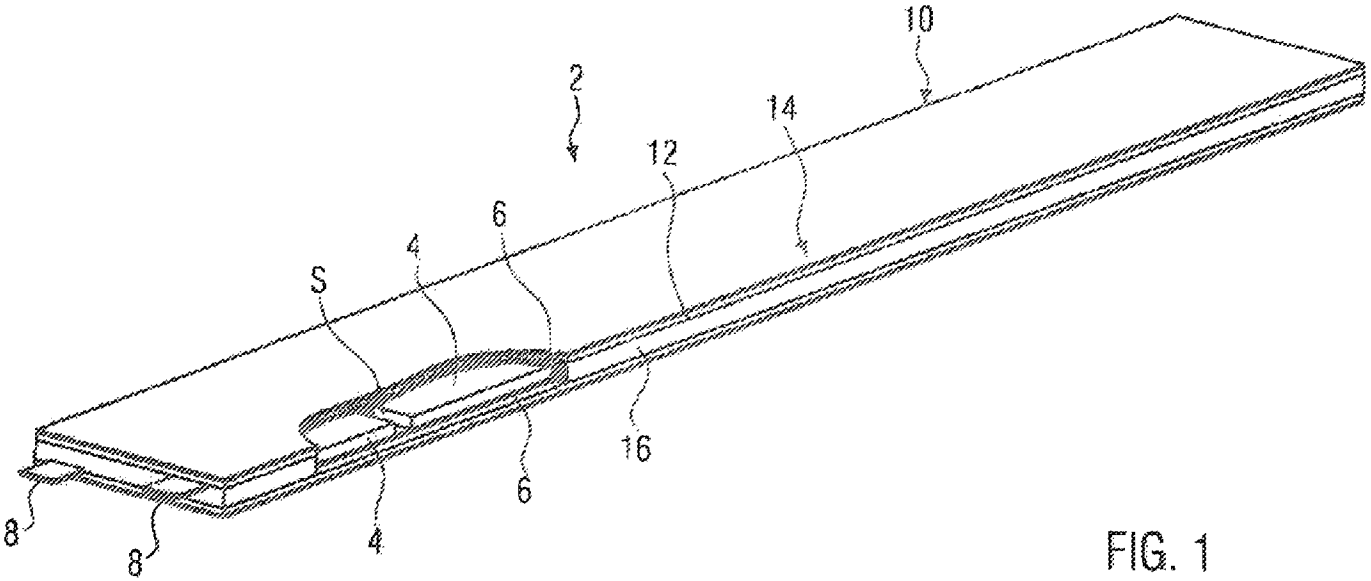
FIG. 1 is a perspective side view of a PTC heating element for a first embodiment of a first electric heating device.

The embodiment shown in FIG. 1 of a PTC heating element marked with reference numeral 2 comprises a plurality of PTC elements 4 which are provided one after the other in longitudinal direction of the PTC heating element 2, which lie between two strip conductors 6 respectively lying at opposite sides of the PTC elements 4 against said elements, in the present case in the form of contact sheets which are extended at a front side of the PTC element 4 for the formation of contact zones 8 beyond the heat-generating element proper. In addition to the above-mentioned components, this heat-generating element of the PTC heating element 2 comprises an insulation layer 10 which adjoins the strip conductors 6 at both sides and respectively covers the heat-generating element of the PTC heating element 2 on the outside. The electrical insulation layer 10 consists of an electrically insulating mass 12 which adheres to a film 14 of polyimide. The electrical insulation layer 10 has previously been prepared by applying the electrically insulating mass 12 to the film 14 and has then been placed on the respective strip conductor 6. The blank of the electrical insulation layer 10 is here chosen in width direction such that it slightly projects beyond the PTC elements 4. A surrounding positioning frame 16 is provided between the opposing edges of the electrical insulation layer 10. This frame is a positioning frame 16 which in longitudinal direction of the PTC heating element 2 comprises webs which are disposed one after the other and guarantee a predetermined distance between PTC elements 4 arranged one after the other. In the area in FIG. 1 which has partly been removed in the drawing, this web corresponds to the gap S.

The strip conductors 6 are confined on the inside by the positioning frame 16. It is just the insulation layer 10 that is positioned on the positioning frame 16 on the outside. At this place the insulating layer 10 is firmly connected in a fluid-tight manner to the positioning frame 16, e.g. glued or connected by overmolding to the positioning frame 16, namely during the injection-molding manufacture of the positioning frame 16 from a heat-resistant plastic. This plastic may e.g. be silicone.

At any rate it must be ensured that in the illustrated embodiment the electrical insulation layer 10 is respectively connected to the edges of the positioning frame 16 in such a manner that no moisture or dirt can pass into the interior of the positioning frame 16.

In the illustrated installation situation the electrical insulation layer 10 is provided on its outside with the film 14, whereas the electrically insulating mass 12 is located between the film 14 and the strip conductor 6.

Figure 2:
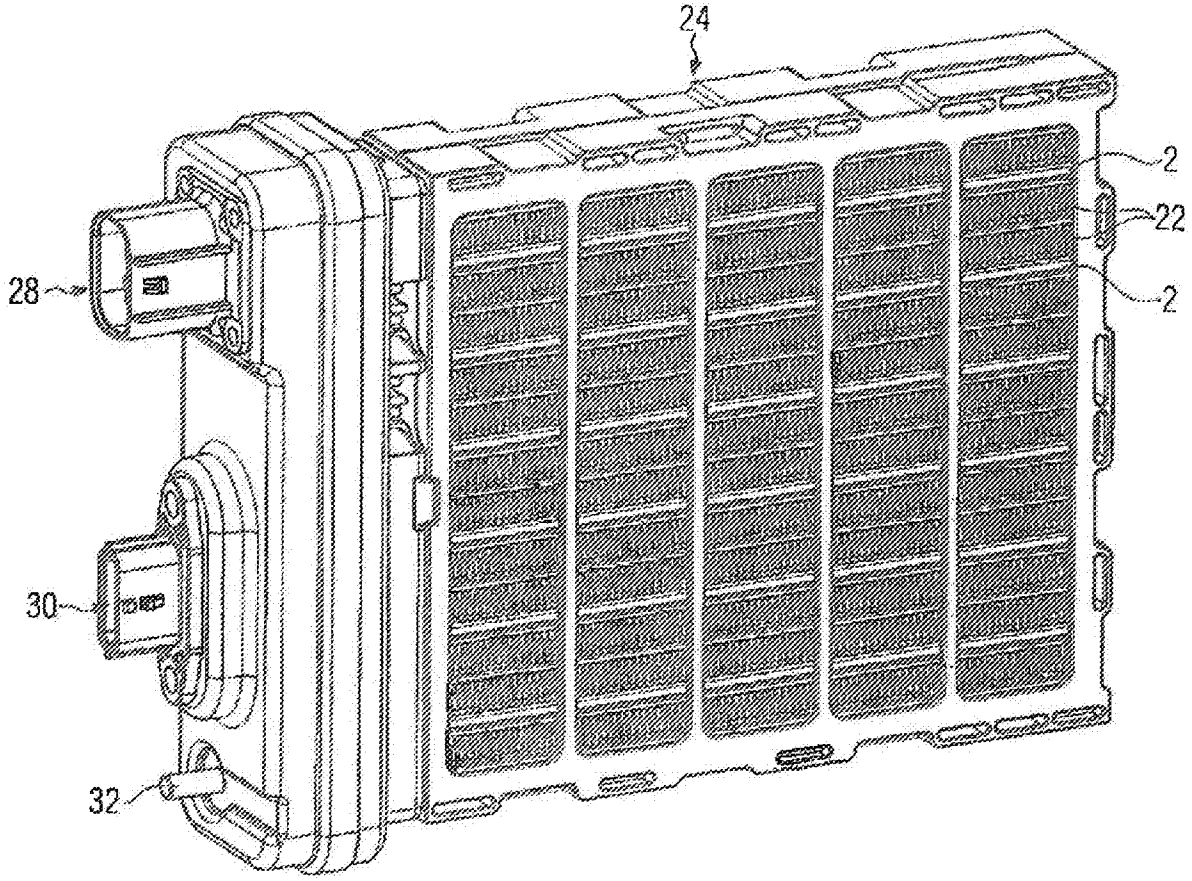
FIG. 2 is a perspective side view of the first electric heating device.

FIG. 2 is a side view of an electric heating device 20 in which plural PTC heating elements 2 are installed as heat-generating layers. In the vicinity of the PTC heating elements 2, corrugated rib elements 22 are respectively provided that adjoin the outside of the electrical insulation layer 10 and are connected in a heat-conducting manner to the PTC heating elements 2 to receive the heat generated in the heat-generating element, first by way of heat conduction, and to deliver it to the air passed transversely through a frame of plastic, which is marked with reference numeral 24. To this end the PTC elements 2 and the corrugated rib elements 22 are inserted as layers into the frame 24 and held with a spring in a pre-tensioned state relative to one another.

This plastic frame 24, which is here bipartite, is connected to a control housing 26 in which the contact tongues 8 are electrically connected to a control device. On the control housing 26, plugs for the power current 28 and the control current 30 are exposed. In the plug of the power current 28, two poles for powering the electric heating device 20 with a plus and a minus phase are exposed. Furthermore, a connection pin 32 with which the control device is grounded projects over the control housing 26.

Depending on the control signals of the control current, the control device provided in the control housing 26 is wired such that all or individual ones of the PTC heating elements 2 which are connected together to form heating circuits are supplied with power current 28. The heat generated thereby in the interior of the PTC heating element 2 is passed by conduction through the strip conductor 6 and in a direction transverse to its area-like extension through the electrical insulation layer 10 and is delivered to the corrugated rib elements 22.

Figure 3:
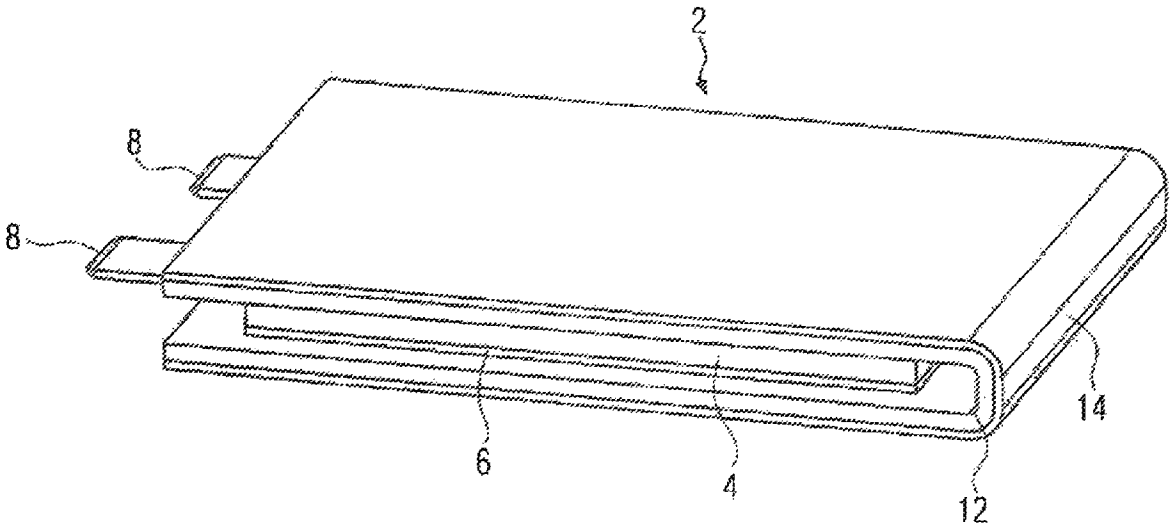
FIG. 3 is a perspective side view of a second embodiment of a PTC heating element for a second electric heating device.

FIG. 3 shows a second embodiment of a PTC heating element 2. Like components are provided with like reference numerals by comparison with the embodiment according to FIG. 1.

In this embodiment, too, the PTC element 4, which is here the only one, lies against opposite strip conductors 6 which are here formed by metallic contact sheets. By way of free punching the contact tongues 8 are integrally formed by way of these metal sheets 6. This heat-generating element of the PTC heating element 2 is folded in in a hybrid film consisting of the film 14 and the electrically insulating mass 12. The film 14 forms the outside of the PTC heating element 2. The PTC element 4 and the contact sheets 6 which are cut to the same dimension are positioned at a distance from a bottom of a U-shaped portion 40, which is formed by the folding in of the heat-generating element in the electrical insulation layer 10. Furthermore, the electrical insulation layer 10 projects over the PTC element 4 and the contact sheets 6 also on the outside. In the finished product, the free space formed thereby over the whole circumference around the PTC element 4 and the contact sheets 6 can be filled with an insulating mass to eliminate or at least reduce air gaps and creep distances between the contact sheets 6 of different polarity. The casting mass used in this process may be of the same material as the electrically insulating mass which forms the corresponding layer, marked with reference numeral 12, of the electrical insulation layer 10.

Figure 4:
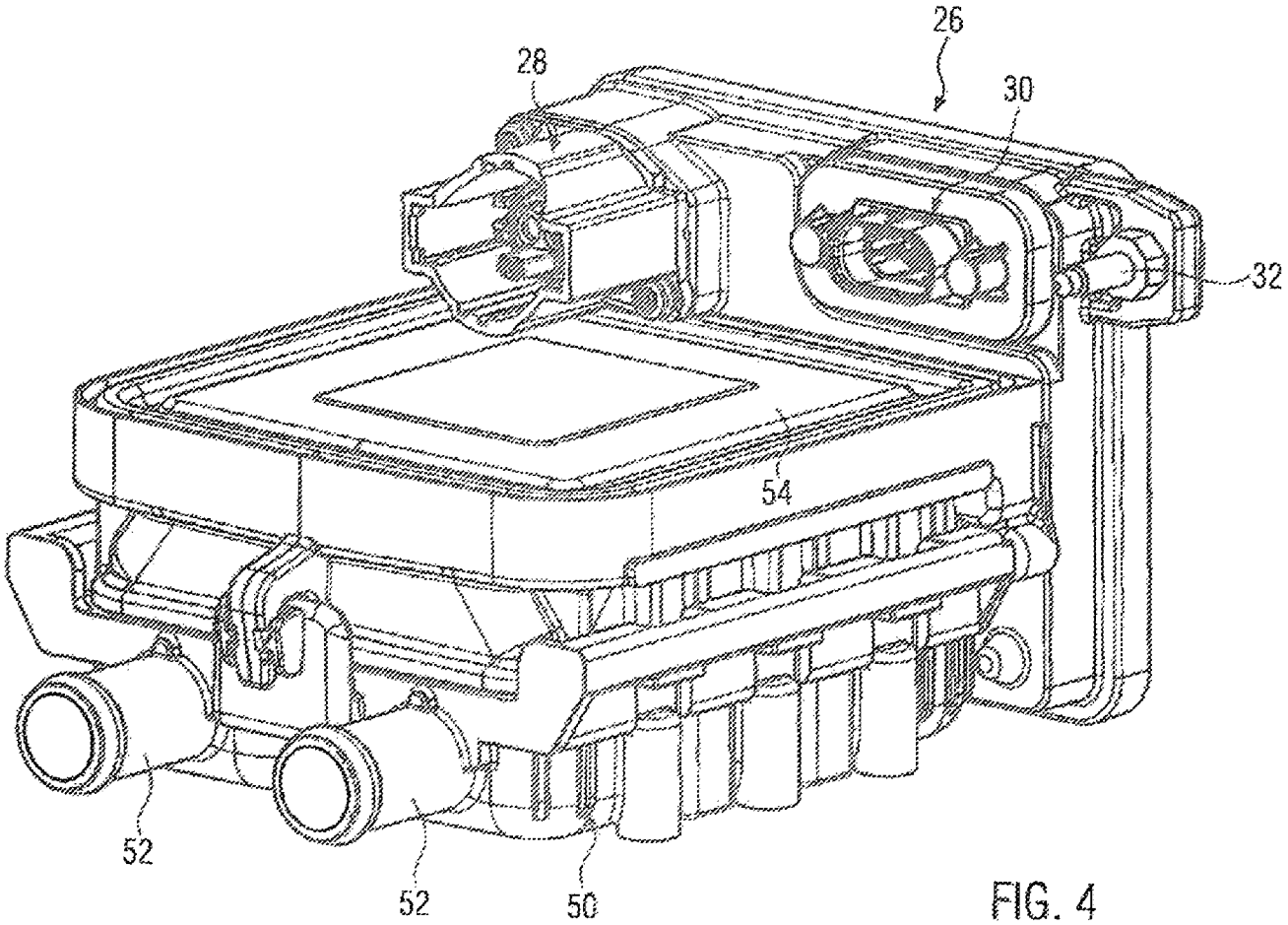
FIG. 4 is a perspective side view of the second electric heating device.

FIG. 4 shows a second embodiment of an electric heating device 20. This electric heating device 20 has a self-contained housing 50 with two connection nozzles 52 through which a circulation chamber formed in the housing 50 is accessible. The inlets and outlets formed by the connection nozzles 52 with respect to the circulation chamber serve the supply, and discharge, respectively, of a liquid medium which is to be heated in the electric heating device 20.

To this end several U-shaped projections project into the circulation chamber, wherein each of the U-shaped recesses opening towards a housing lid 54 marked with reference numeral 54 is provided with at least one PTC heating element 2 according to FIG. 3. The U-shaped recesses are normally formed by heating ribs of a material of good thermal conductivity, e.g. aluminum. The PTC heating elements 2 lie either directly against opposing inner surfaces of the heating ribs and are thus cast in a heat-conducting manner or, however, are pressed therein by a wedge element, as described in EP 1 872 986 A1 of the present applicant. The embodiment shown in FIG. 4 also has a control housing 26 with plugs 28, 30 for the power current 28 and the control current 30 which is there supplied with plus and minus pole to the electric heating device 20. Furthermore, a ground connection 32 is also formed.

What is claimed is:

1. A PTC heating element comprising:
at least one PTC element,
electrical strip conductors each having an inner surface in electrical contact with the PTC element, and
an electrical insulation layer placed on an outer surface of at least one of the electrical strip conductors,
wherein the electrical insulation layer comprises a film and an electrically insulating mass of good thermal conductivity applied to the film,
wherein the electrically insulating mass is a paste-like mass applied to the film as a coating, which electrically insulating mass has a layer thickness of between 100 and 300 μm,
wherein the electrically insulating mass is cross-linked, and
wherein the electrically insulating mass contacts the outer surface of the at least one of the electrical strip conductors.

2. A PTC heating element according to claim 1, wherein the electrically insulating mass is filled with particles of good thermal conductivity of between 1-5 W/mK.

3. A PTC heating element according to claim 2, wherein the proportion of the particles of good thermal conductivity in the electrically insulating mass is between 85 vol. % and 95 vol. %.

4. A PTC heating element according to claim 3, wherein the particles of good thermal conductivity are made from aluminum oxide.

5. A PTC heating element according to claim 1, wherein the electrically insulating mass is formed by a silicone mass.

6. A PTC heating element according to claim 1, wherein the insulation layer consists of the film (14) and the electrically insulating mass.

7. A PTC heating element according to claim 1, wherein the electrically insulating mass is self-adhesive and adheres to the film.

8. A PTC heating element according to claim 1, wherein the film is a polyimide film.

9. A PTC heating element according to claim 1, wherein the electrical insulation layer has a thickness of not more than 250 μm.

10. A PTC heating element according to claim 1, wherein the electrical insulation layer has a dielectric strength of at least 3 kV DC at a thickness of 250 μm.

11. A PTC heating element according, to claim 1, wherein the electrical insulation layer has a specific dielectric strength of >20 kV/mm in a temperature range of −40° C. to +260° C.

12. A PTC heating element according to claim 1, wherein the electrical insulation layer is temperature-stable up to 260° C.

13. A PTC heating element according to claim 1, wherein a liquid phase of the electrically insulating mass is formed from a cold-curing 2-component mass.

14. A PTC heating element comprising:
at least one PTC element,
electrical strip conductors each having an inner surface in electrical contact with the PTC element, and
an electrical insulation layer provided on an outer surface of at least one of the electrical strip conductors,
wherein the electrical insulation layer comprises a film and an electrically insulating mass of good thermal conductivity applied to the film,
wherein the mass is filled with particles of good thermal conductivity of between 1-5 W/mK,
wherein the proportion of the particles of good thermal conductivity is between 85 vol. % and 95 vol. %, and
wherein the electrically insulating mass has a layer thickness of between 100 and 300 μm.

15. A PTC heating element according to claim 14, wherein the insulation layer consists of the film and the electrically insulating mass.

16. A PTC heating element comprising:
at least one PTC element,
electrical strip conductors each having an inner surface in electrical contact with the PTC element, and
an electrical insulation layer placed on an outer surface of at least one of the electrical strip conductors,
wherein the electrical insulation layer comprises a film and an electrically insulating mass of good thermal conductivity applied to the film,
wherein the electrical insulation layer has a dielectric strength of at least 3 kV DC at a thickness of 250 μm,
wherein the electrical insulation layer has a specific dielectric strength of >20 kV/mm in a temperature range of −40° C. to +260° C.,
wherein the electrical insulation layer is temperature-stable up to 260° C.,
wherein the electrically insulating mass is formed by a cross-linked plastic applied to the film as a coating in a paste-like form, which electrically insulating mass has a layer thickness of between 100 and 300 μm, and
wherein the coating of the electrically insulating mass is set after being applied to the film and contacted against the outer surface of the at least one of the electrical strip conductors.

17. An electric heating device for an automotive vehicle, comprising:
heat-emitting surfaces, and
a PTC heating element comprising,
at least one PTC element,
electrical strip conductors each having an inner surface in electrical contact with the PTC element, and
an electrical insulation layer provided on an outer surface of at least one of the electrical strip conductors, wherein the electrical insulation layer comprises a film and an electrically insulating mass of good thermal conductivity applied to the film, and wherein the PTC heating element lies in a heat-conducting manner against the heat-emitting surfaces with interposition of the least one electrical insulation layer therebetween.

* * * * *